US005819823A

United States Patent [19]

Brändström

[11] Patent Number: 5,819,823

[45] Date of Patent: Oct. 13, 1998

[54] UMBRELLA VALVE ASSEMBLY HAVING DRIP-PREVENTION STRUCTURE DISPOSED ABOUT PRODUCT FILL PIPE

[75] Inventor: Per Brändström, Hunnebostrand, Sweden

[73] Assignee: Tetra Laval Holdings & Finance, S.A., Pully, Switzerland

[21] Appl. No.: 704,387

[22] Filed: Aug. 28, 1996

[51] Int. Cl.[6] ..... B67C 3/02

[52] U.S. Cl. ..... 141/311 A; 141/115; 141/264; 141/275

[58] Field of Search ..... 141/115, 85, 172, 141/181, 263, 264, 275, 392, 311 A; 222/571

[56] References Cited

U.S. PATENT DOCUMENTS

| | | | |
|---|---|---|---|
| 194,726 | 8/1877 | Ross . | |
| 1,621,638 | 3/1927 | McIntyre et al. . | |
| 2,213,998 | 9/1940 | Sifkovitz | 137/242 |
| 2,608,335 | 8/1952 | Rohdin . | |
| 2,651,445 | 9/1953 | Kennedy, Jr. . | |
| 2,710,121 | 6/1955 | Rees . | |
| 2,723,069 | 11/1955 | Shanhouse et al. . | |
| 2,763,416 | 9/1956 | Wormser . | |
| 2,839,094 | 6/1958 | Reno | 141/263 |
| 2,874,734 | 2/1959 | Luckock et al. | 141/264 |
| 2,913,016 | 11/1959 | Luther . | |
| 2,923,272 | 2/1960 | Emmert . | |
| 3,005,473 | 10/1961 | Ring . | |
| 3,106,231 | 10/1963 | Lehmann . | |
| 3,155,125 | 11/1964 | Mojonnier et al. | 141/163 X |
| 3,330,310 | 7/1967 | Heffelfinger et al. . | |
| 3,386,480 | 6/1968 | Riesenberg | 141/172 X |
| 3,402,857 | 9/1968 | Ecklund et al. . | |
| 3,486,840 | 12/1969 | Burton et al. . | |
| 3,870,089 | 3/1975 | Laub, III | 141/115 X |
| 3,924,666 | 12/1975 | Raison . | |
| 4,050,473 | 9/1977 | Cho . | |
| 4,073,307 | 2/1978 | Royce . | |
| 4,074,836 | 2/1978 | Muller, Jr. . | |
| 4,185,669 | 1/1980 | Jevakohoff . | |
| 4,235,265 | 11/1980 | Feliks | 141/85 |
| 4,537,335 | 8/1985 | Rangwala et al. . | |
| 4,606,382 | 8/1986 | Biller et al. | 141/1 |
| 4,712,665 | 12/1987 | McDonald et al. | 141/172 X |
| 4,749,010 | 6/1988 | Petell | 141/115 X |
| 4,792,068 | 12/1988 | Trygg . | |
| 4,815,666 | 3/1989 | Gacka et al. . | |
| 5,287,997 | 2/1994 | Rodrigue et al. . | |
| 5,375,813 | 12/1994 | Rozinsky . | |
| 5,437,316 | 8/1995 | McPherson | 141/115 X |

FOREIGN PATENT DOCUMENTS

| | | | |
|---|---|---|---|
| 1413053 | 7/1988 | U.S.S.R. | 141/115 |

*Primary Examiner*—J. Casimer Jacyna
*Attorney, Agent, or Firm*—Michael A. Catania

[57] ABSTRACT

A filling system is set fort that assists in maintaining the hygienic nature of the filling process. The filling system includes a fill pipe having an inlet for receiving a liquid product and an outlet overlying a container path along which the containers are successively transported for filling beneath the fill pipe. A drip-prevention structure is disposed about the outlet end of the fill pipe and includes a downwardly directed honed edge. The filling system further includes an umbrella valve assembly. The umbrella valve assembly comprises a linear actuator, an umbrella valve cone disposed proximate the outlet end of the fill pipe, and a valve rod disposed in the fill pipe between the linear actuator and the valve cone. The linear actuator is connected to move the valve rod and umbrella valve cone between a first position in which product is prevented from exiting the fill pipe and a second position that allows product to flow from the outlet of the fill pipe. The downwardly directed honed edge of the drip-prevention structure wipes the umbrella valve cone when the linear actuator moves the valve rod and umbrella valve cone between the second and first positions during each successive filling cycle.

15 Claims, 6 Drawing Sheets

UMBRELLA VALVE ASSEMBLY HAVING DRIP-PREVENTION STRUCTURE DISPOSED ABOUT PRODUCT FILL PIPE

FIELD OF THE INVENTION

The present invention is directed to a fill system of, for example, a packaging machine, having an umbrella valve structure that reduces the likelihood of container contamination. More particularly, the present invention is directed to an umbrella valve assembly having a drip-prevention structure disposed about a product fill pipe of a fill system.

BACKGROUND

Carton filling machines are known and are in wide use in the packaging industry. Such system have been proposed for filling cartons with liquids, such as milk or juice. Typically, the cartons are pre-formed and sealed at the bottom. The cartons are placed on a conveyor which advances periodically in a series of equal steps. The cartons are often first passed through a sterilization station wear the interior of each carton is sterilized. The cartons are then passed to a fill station where the liquid cartons are transfer of a supply tank to fill the carton. The carton then passes to a closing station where the top of the carton is folded together, and finally the carton passes to a sealing station where the carton is heat-sealed at the top. The overall filling and sealing process is typically performed under very hygienic conditions.

One such machine is described in U.S. Pat. No. 5,287,997, titled "CARTON FILLING SYSTEM", issued Feb. 22, 1994. The machine disclosed in the '997 patent includes a fill system that utilizes an umbrella valve assembly to control product flow from the outlet end of a fill pipe. Although not specifically directed to the umbrella valve assembly used in connection with the fill pipe outlet, the umbrella valve assembly shown in FIG. 3 of the '997 patent illustrates a typical mode of engagement between the umbrella-shaped sealing member and its corresponding valve seat.

When such an engagement is used to control the flow of liquid product from the outlet of the fill pipe, residual product often accumulates along the sides and upper portions of the sealing member. Over time, such an accumulation significantly increases the risk of contamination of the product as the containers are filled and sealed.

SUMMARY OF THE INVENTION

A filling system is set fort that assists in maintaining the hygienic nature of the filling process. The filling system includes a fill pipe having an inlet for receiving a liquid product and an outlet overlying a container path along which the containers are successively transported for filling beneath the fill pipe. A drip-prevention structure is disposed about the outlet end of the fill pipe and includes a downwardly directed honed edge. The filling system further includes an umbrella valve assembly. The umbrella valve assembly comprises a linear actuator, an umbrella valve cone disposed proximate the outlet end of the fill pipe, and a valve rod disposed in the fill pipe between the linear actuator and the valve cone. The linear actuator is connected to move the valve rod and umbrella valve cone between a first position in which product is prevented from exiting the fill pipe and a second position that allows product to flow from the outlet of the fill pipe. The downwardly directed honed edge of the drip-prevention structure wipes the umbrella valve cone when the linear actuator moves the valve rod and umbrella valve cone between the second and first positions during each successive filling cycle.

DESCRIPTION OF THE PREFERRED EMBODIMENT

Figure 1:
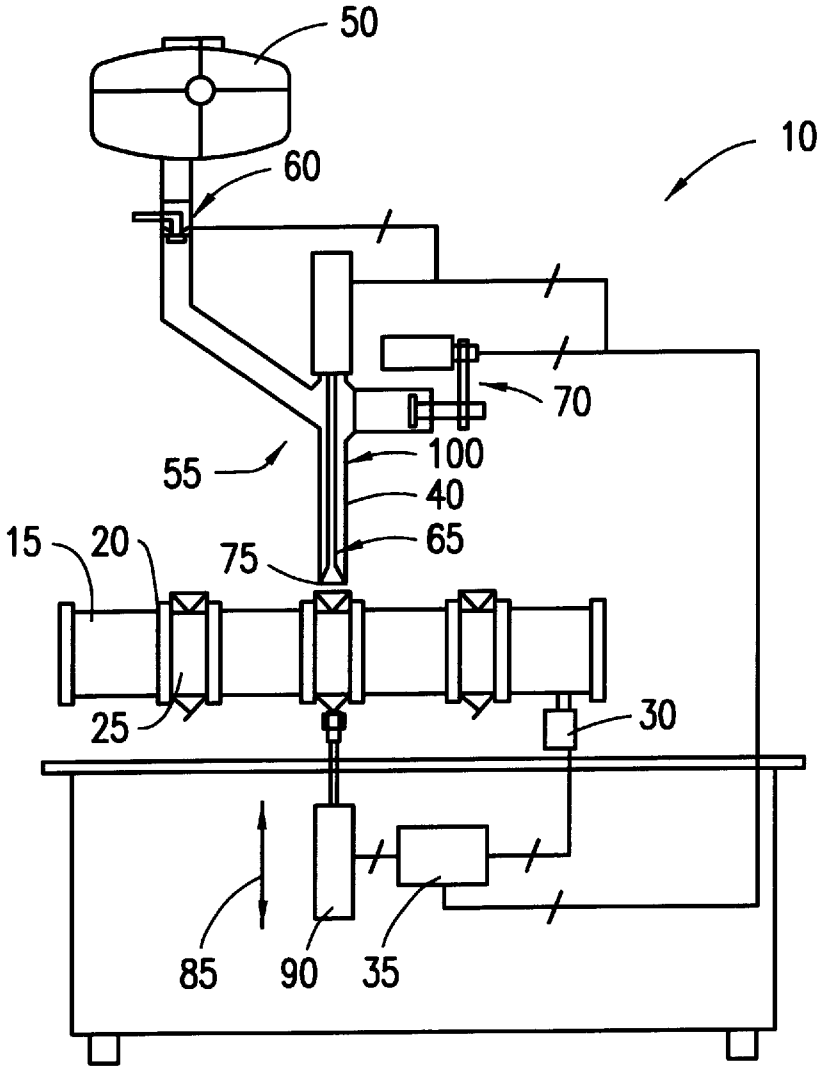
FIG. 1 is a diagrammatic view of one embodiment of a filling machine that may include a drip-prevention structure.

FIG. 1 is a diagrammatic view of one of the many types of filling machines that may utilize a filling system, shown generally at 10, having an umbrella valve and associated structures constructed and operated in the manner described below. As shown in FIG. 1, a conveyor 15 having a plurality of carton support members 20 is driven by, for example, a motor. The support members 20 each support a single, open topped carton 25 that has its bottom sealed. The conveyor 15 is driven by motor 30 under the control of, for example, a programmable control system 35, or the like, to present the containers 20 successively below a fill pipe 40 of the fill system 10.

A storage or balance tank 50 containing a liquid product is connected to provide a flow of the liquid product through a flow control system 55. The flow control system, generally stated, comprises an inlet valve 60, an umbrella valve assembly 65, a pump mechanism 70, the fill pipe 40, and a drip-prevention structure 75. The inlet and umbrella valves 60 and 65 are controlled to control the flow of the liquid product into and from the pump chamber of the pump mechanism. The pump mechanism 70 may be any type of pump mechanism, such as one disclosed in U.S. Pat. No. 4,877,160, which patent is incorporated by reference, or in the previously cited '997 patent. The pump mechanism 70 may be driven, for example, by a servomotor under the direction of the programmable control system 35.

As illustrated, the containers 25 are successively brought below the umbrella valve outlet for filling with the liquid product by, for example, the conveyor with. To begin filling, each container is lifted in a direction of arrow 85 so that the outlet end of the umbrella valve assembly 65 are disposed interior to the container. This lifting may be done using a lifting mechanism 90 that executes a motion profile under the direction of, for example, the programmable control system 35. One such lifter mechanism and corresponding carton gripping mechanism are disclosed in U.S. Ser. No. 08/315,401 and U.S. Ser. No. 08/315,410. The flow control system 55 is then operated to fill the container 25 with liquid product as the container 25 is lowered from the nozzle by the carton lifter mechanism 90, preferably maintaining the flexible outlet extension 75 below the level of the liquid throughout its downward motion. Other lifter mechanisms are likewise suitable for use in the present system, the foregoing lifter mechanism being merely exemplary.

Figure 2:
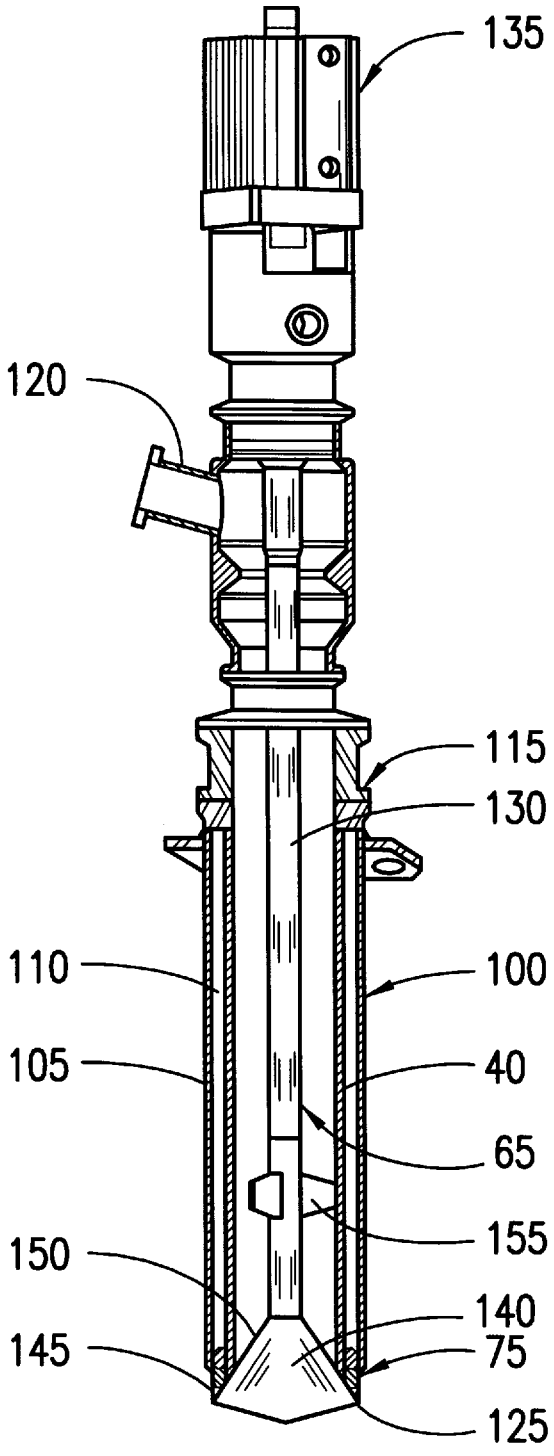
FIG. 2 is a partial cross-sectional view of one embodiment of a fill pipe and umbrella valve assembly including one embodiment of a drip-prevention structure.

FIG. 2 illustrates one embodiment of a fill pipe assembly, shown generally at 100. As illustrated, the assembly 100 includes the fill pipe 40 that is concentrically disposed within an insulating pipe 105. The interior portion of the insulating pipe 105 and the exterior of the fill pipe 40 define an insulating area 110 therebetween. The upper portion of the insulating area 110 is terminated at joint portion 115 while the lower portion of the insulating a real 10 is terminated by a drip-prevention structure 75.

The fill pipe 40 includes an inlet 120 for receiving a liquid product from the storage tank 50 and an outlet 125. The flow of product from the outlet 125 and into a container disposed beneath the outlet 125 is controlled by the umbrella valve assembly 65. The umbrella valve assembly 65 includes a piston rod 130 that is connected at one end thereof to a linear actuator 135 and at the other end thereof to an umbrella-shaped valve cone 140. The valve cone 140 and rod 130 are movable between a first position, shown in FIG. 2, in which the upper surface of the valve cone 140 engages a protruding, honed edge 145 of the drip-prevention structure 75, and a second position, shown in FIG. 4, in which the cone 140 is disengaged from the drip-prevention structure 75. While in the first position, the outlet 125 of the fill pipe 40 is effectively closed thereby preventing product from exiting into a container 25 disposed beneath the pipe 40. While in the second position, the outlet of the fill pipe 40 is opened to thereby allow product to flow about the upper portion 150 of the valve cone, exiting the outlet 125 to fill the container. Preferably, the rod 130 is provided with a plurality of orthoganally disposed guide members 155 that assist in maintaining the rod 130 in its proper position within the fill pipe 40 when the rod 130 and valve cone 140 are moved by the linear actuator 135. The valve cone 140 is preferably made from a polymer material such as High Density Polyethylene or a Teflon® material such as PTFT. The interconnection between the valve cone 140 and the rod 130 can take on many forms. One such interconnection is illustrated in U.S. Ser. No. 08/315,246, filed Sep. 29, 1994, entitled "Packaging Machine For Filling Primary And Secondary Products Into A Container", incorporated herein by reference. Other interconnections are likewise contemplated, the foregoing interconnection merely being one example of a suitable construction.

Figure 3:
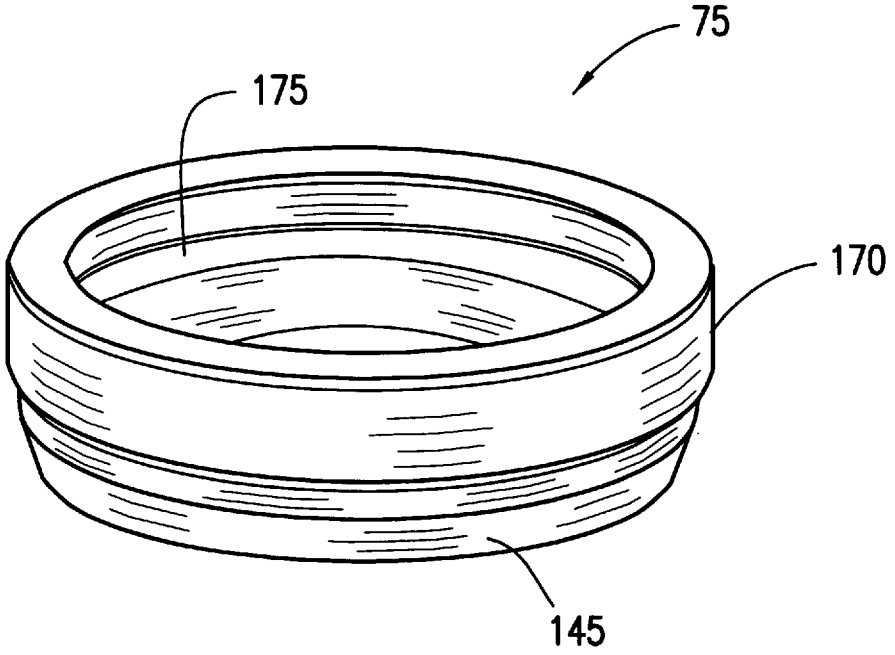
FIG. 3 is a perspective view of one embodiment of the drip-prevention structure of FIG. 2.

FIG. 3 illustrates one embodiment of a drip-prevention structure 75 suitable for use in the fill-pipe assembly 65. As shown, the drip-prevention structure 75 includes a collar portion 170 having an interior diameter corresponding to the outside diameter of the fill pipe 40 and an exterior diameter corresponding to the interior diameter of the insulating pipe 105. The interior portion of the collar 170 may be provided with a groove 175 that is dimensioned to engage a corresponding flange 180 at the outlet 125 of the fill pipe 40 (See FIG. 4). As such, the collar portion 170 is dimensioned to form an effective seal of the lower portion of the insulating area 110. The protruding, honed edge 145 extends downward from and about the entire circumference of the collar portion 170. The protruding, honed edge 145 and the collar portion 170 are preferably made as a single, integral structure from a suitable polymer material. The protruding, honed edge 145 is thus preferably flexible.

It shall be understood that the drip-prevention structure 75 may be made from any suitable flexible material such as soft plastic or rubber of a suitable hardness. In the case of packaging foodstuffs, the drip-prevention structure 75 may more preferably be made from nitrile, silicone rubber, or the like.

Figure 4:
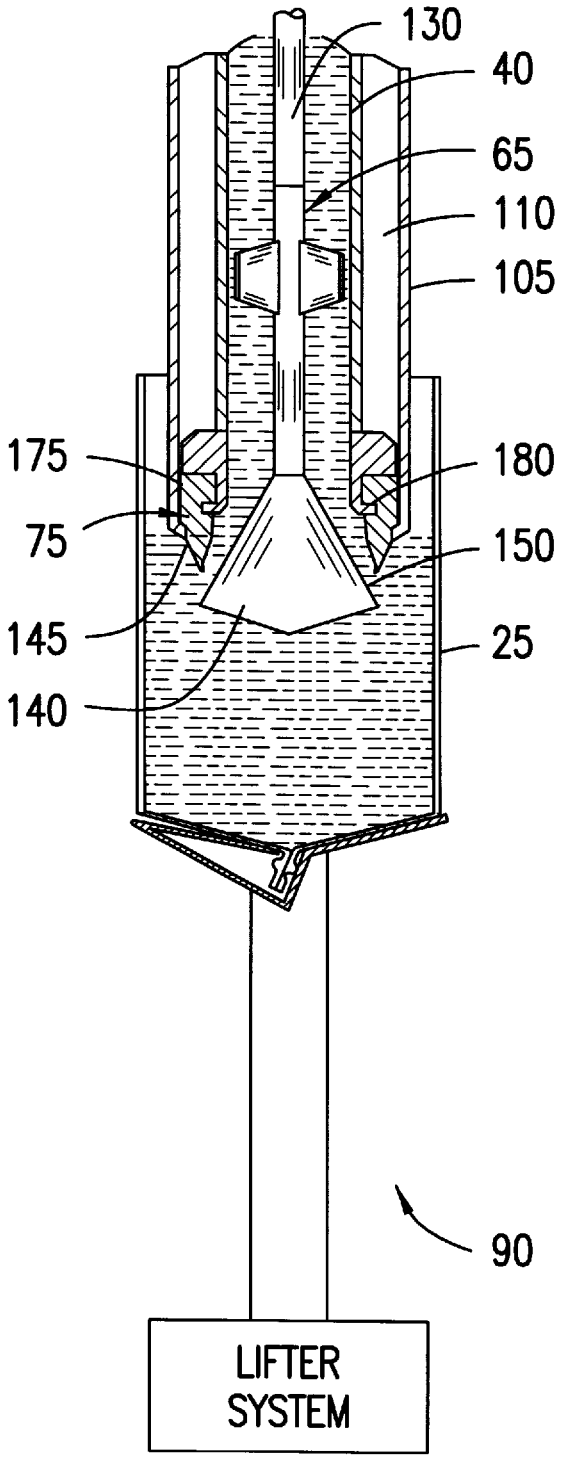
FIGS. 4–6 illustrate one manner of operating the system of FIG. 1.
Figure 5:
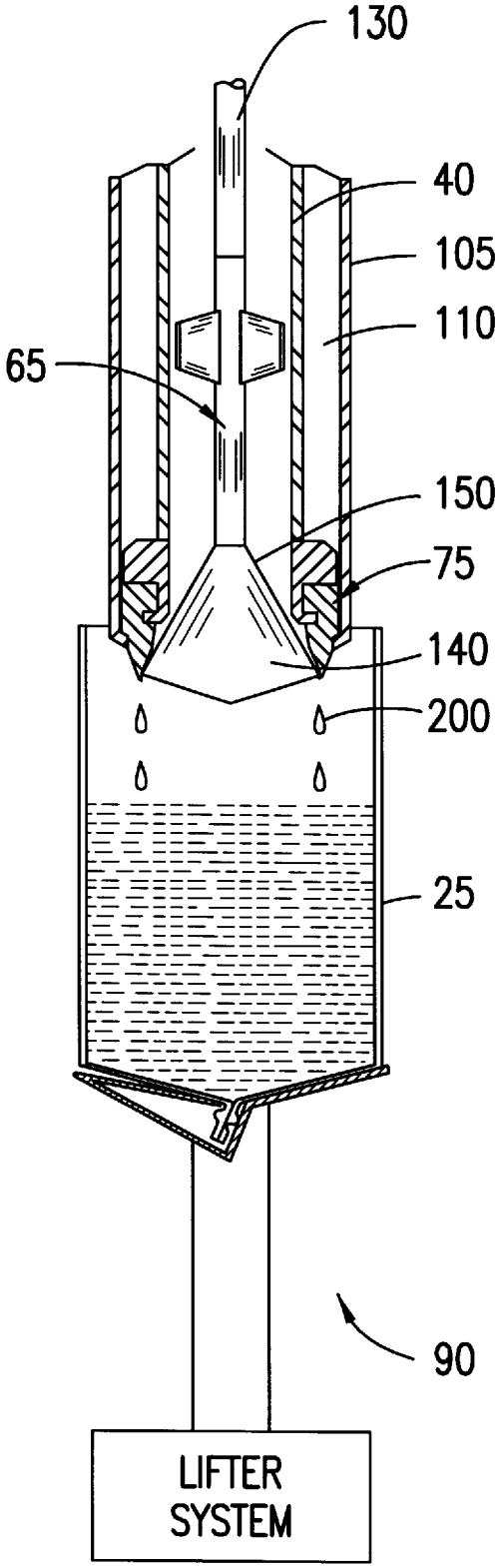
Figure 6:
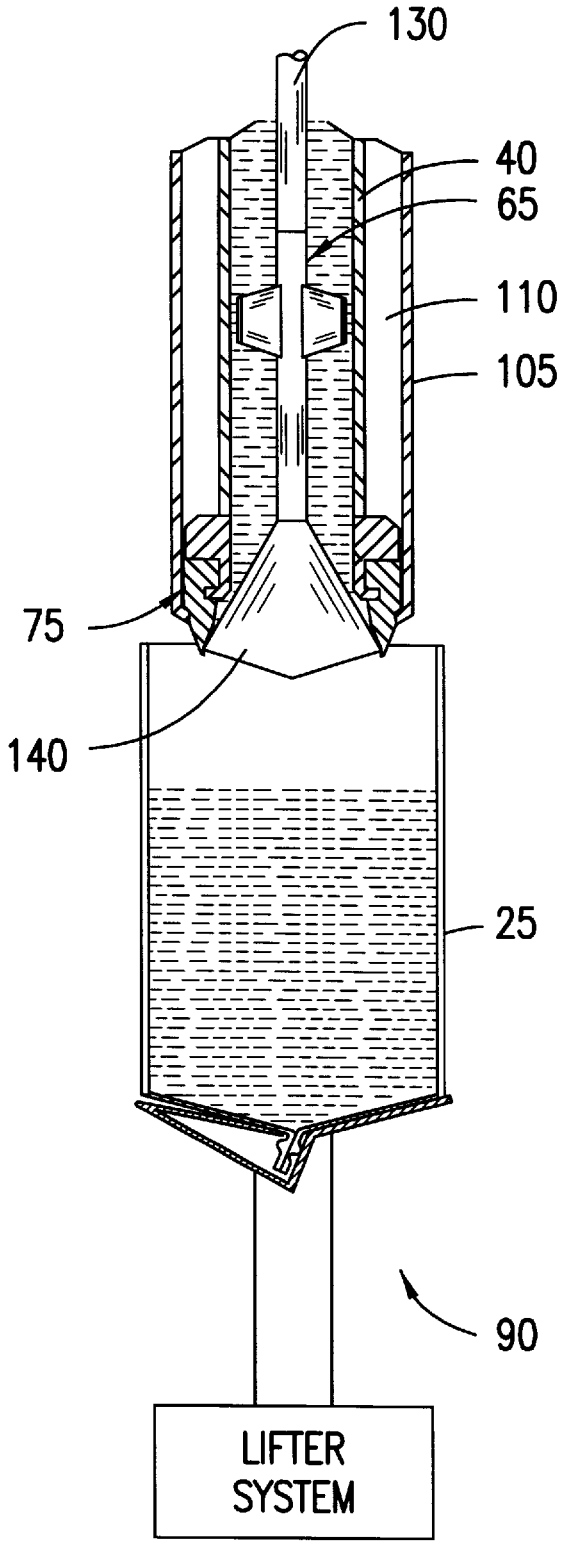

FIGS. 4–6 illustrate the relative operation and engagement between the valve cone 140 and the drip-prevention structure 75 during a single fill cycle. During the initial stages of the filling cycle, the outlet 125 of the fill pipe 40 and the container 25 are moved relative to one another so that the outlet end of the fill pipe 40 is brought proximate the bottom interior of the container 25 that is to the filled. If it is desirable to reduce the mixing of product and air during the filling cycle, a flexible outlet extension, such as the one disclosed in U.S. Ser. No. 08/693,810 (Attorney Docket No. 10942US01), "FILL SYSTEM INCLUDING A VALVE ASSEMBLY AND CORRESPONDING STRUCTURE FOR REDUCING THE MIXING OF PRODUCT AND AIR DURING CONTAINER FILLING", filed Aug. 2, 1996. Such relative movement may be accomplished using the lifter system 90. During the initial stages, the valve cone 140 is in the first position so that the product does not exit the outlet 125 of the fill pipe 40.

As illustrated in FIG. 4, once the fill pipe outlet 125 is proximate the bottom interior of the container 25, the linear actuator 135 drives the rod 130 and valve cone 140 to the second position to thereby allow product to flow into the container 25. The lifter system 90 then lowers the container 25 in accordance with a predetermined motion profile which maintains the end of the fill pipe assembly 100 below the surface of the liquid product being dispensed. During the time in which the liquid product is dispensed from the fill pipe 40, the valve cone 140, and particularly, the upper surfaces of sloped sides 150 of the cone are in contact with the product. As such, under ordinary circumstances, residual product may accumulate on the valve cone surfaces and present a threat to the otherwise hygienic nature of the filling cycle. This problem is particularly acute when the liquid product is highly viscous. To counter this threat, the illustrated system is configured to allow the honed edges 145 of the drip-prevention structure 75 to engage the upper surfaces 150 of the valve cone 140 the linear actuator 135 drives the rod 130 and valve cone 140 to the first position. This relative engagement and movement, as shown in FIGS. 5 and 6, causes the honed edge 145 of the drip-prevention structure 75 to wipe the surfaces of the valve cone 140 to remove any residual product from the surfaces 150 of the valve cone 140, and dispensing the fresh residual product 200 into the container 25. Since the wiping action occurs during each filling cycle, the liquid product is not allowed to accumulate on the valve cone 140, thereby decreasing the likelihood that any accumulation of residual product will threaten the hygienic nature of the filling process. This wiping action may occur with or without product in the fill pipe 40. Ultimately, the lifter system 90 lowers the container 25 until the lower end of the fill pipe assembly 100 is completely removed from the interior of the container. Another container is then conveyed beneath the fill pipe assembly so that the filling cycle can be repeated.

While particular elements, embodiments and applications of the present invention have been shown and described, it will be understood, of course, that the invention is not limited thereto since modifications may be made by those skilled in the art, particularly in light of the foregoing teachings. It is, therefore, contemplated by the appended claims to cover such modifications as incorporate those features which come within the spirit and scope of the invention.

I claim:

1. A filling system comprising:

a) a fill pipe having an inlet for receiving a liquid product and an outlet overlying a container path;

b) a drip-prevention structure disposed about the outlet end of the fill pipe and including a downwardly directed honed edge;

c) an umbrella valve assembly comprising i) a linear actuator, ii) an umbrella valve cone disposed proximate the outlet end of the fill pipe, iii) a valve rod disposed in the fill pipe between the linear actuator and the valve cone, the linear actuator connected to move the valve rod and umbrella valve cone between a first position in which product is prevented from exiting the fill pipe and a second position that allows product to flow from the outlet of the fill pipe;

d) the downwardly directed honed edge of the drip-prevention structure being resiliently deformable and wiping an exterior surface of the umbrella valve cone as the linear actuator moves the valve rod and umbrella valve cone from the second position to the first position to thereby directing any excess product on the exterior surface of the umbrella downward from the outlet end of the fill pipe into a container being filled with product.

2. A fill system as claimed in claim 1 wherein the drip-prevention structure comprises a collar engaging the outlet of the fill pipe, the downwardly directed honed edge extending from the collar.

3. A fill system as claimed in claim 2 wherein the collar and downwardly directed honed edge are formed as a single integral structure.

4. A fill system as claimed in claim 3 wherein the downwardly directed honed edge of the drip-prevention mechanism are formed from a material selected from the group of nitrile and silicone rubber.

5. A fill system as claimed in claim 1 wherein the downwardly directed honed edge of the drip-prevention mechanism are formed from a material selected from the group of nitrile and silicone rubber.

6. A fill system as claimed in claim 1 and further comprising:

a) moving means for relatively moving a container and the outlet toward one another to a first position in which the outlet of the fill pipe is disposed proximate the interior bottom of the container and a second position in which the outlet of the fill pipe is disposed distal from the interior bottom of the container.

7. A fill system as claimed in claim 1 and further comprising an insulating pipe disposed about and spaced from the exterior of the fill pipe to form an insulating layer therebetween, the drip-prevention structure sealing an end of the insulating layer.

8. A fill system as claimed in claim 7 wherein the insulating layer is air.

9. A filling system comprising:

a) a fill pipe having an inlet for receiving a liquid product and an outlet overlying a container path;

b) an insulating pipe disposed about and spaced from the fill pipe and defining an insulating layer therebetween;

c) a drip-prevention structure disposed about the outlet end of the fill pipe the drip-prevention structure comprising i) a collar disposed about the fill pipe and forming a seal between the fill pipe and the insulating pipe, ii) a downwardly directed honed edge extending down from the collar;

d) an umbrella valve assembly comprising i) a linear actuator, ii) an umbrella valve cone disposed proximate the outlet end of the fill pipe, iii) a valve rod disposed in the fill pipe between the linear actuator and the valve cone, the linear actuator connected to move the valve rod and umbrella valve cone between a first position in which product is prevented from exiting the fill pipe and a second position that allows product to flow from the outlet of the fill pipe;

e) the downwardly directed honed edge of the drip-prevention structure being resiliently deformable and wiping an exterior surface of the umbrella valve cone as the linear actuator moves the valve rod and umbrella valve cone from the second position to the first position to thereby directing any excess product on the exterior surface of the umbrella downward from the outlet end of the fill pipe and into a container being filled with product.

10. A fill system as claimed in claim 9 wherein the collar and downwardly directed honed edge are formed as a single integral structure.

11. A fill system as claimed in claim 10 wherein the collar and downwardly honed edge are formed from a flexible polymer material.

12. A fill system as claimed in claim 10 wherein the downwardly directed honed edge of the drip-prevention mechanism are formed from a material selected from the group of nitrile and silicone rubber.

13. A fill system as claimed in claim 9 wherein the downwardly directed honed edge of the drip-prevention mechanism are formed from a material selected from the group of nitrile and silicone rubber.

14. A fill system as claimed in claim 9 and further comprising:

a) moving means for relatively moving a container and the outlet toward one another to a first position in which the outlet of the fill pipe is disposed proximate the interior bottom of the container and a second position in which the outlet of the fill pipe is disposed distal from the interior bottom of the container.

15. A fill system as claimed in claim 9 wherein the insulating layer is air.

* * * * *